United States Patent [19]

Peterson

[11] 4,211,178

[45] Jul. 8, 1980

[54] SEWING MACHINE MOUNT

[75] Inventor: Wesley R. Peterson, Boundbrook, N.J.

[73] Assignee: The Singer Company, Stamford, Conn.

[21] Appl. No.: 16,057

[22] Filed: Feb. 28, 1979

[51] Int. Cl.[2] ..... D05B 75/00; D05B 75/02

[52] U.S. Cl. ..... 112/258; 112/262.1; 112/217.1; 312/26; 248/680

[58] Field of Search ..... 112/258, 260, 262.1, 112/217.1; 312/24, 26, 27, 30, 208; 248/680, 681, 675

[56] References Cited

U.S. PATENT DOCUMENTS

| | | | |
|---|---|---|---|
| 1,450,183 | 4/1923 | Moon | 248/680 |
| 1,481,396 | 1/1924 | Ternes | 248/680 |
| 2,802,710 | 8/1957 | Aynes | 312/30 |
| 2,899,249 | 8/1959 | Kishibay | 112/217.1 |
| 4,123,124 | 10/1978 | Peets | 312/30 X |

FOREIGN PATENT DOCUMENTS 1188177 12/1957 France .

*Primary Examiner*—Werner H. Schroeder
*Assistant Examiner*—Andrew M. Falik
*Attorney, Agent, or Firm*—Robert E. Smith; Elliot A. Lackenbach; Edward L. Bell

[57] ABSTRACT

A mount system for mounting sewing machines provided with hinge pin sockets adjacent an edge of the work supporting surface, comprising a pair of elongated equal height mounting brackets having pins adapted to be inserted into and locked within the hinge pin sockets, the brackets being adapted at their other end to be mounted to a machine supporting surface or shelf, together with a machine rest also adapted to be mounted with the machine supporting surface to sustain the front of the sewing machine bed, the system thereby locating the work supporting surface at the desired height independent of the machine bed height or depth through the fixed hinge pin socket distance relationship, and the fixed height of the bracket pin on the bracket.

21 Claims, 4 Drawing Figures

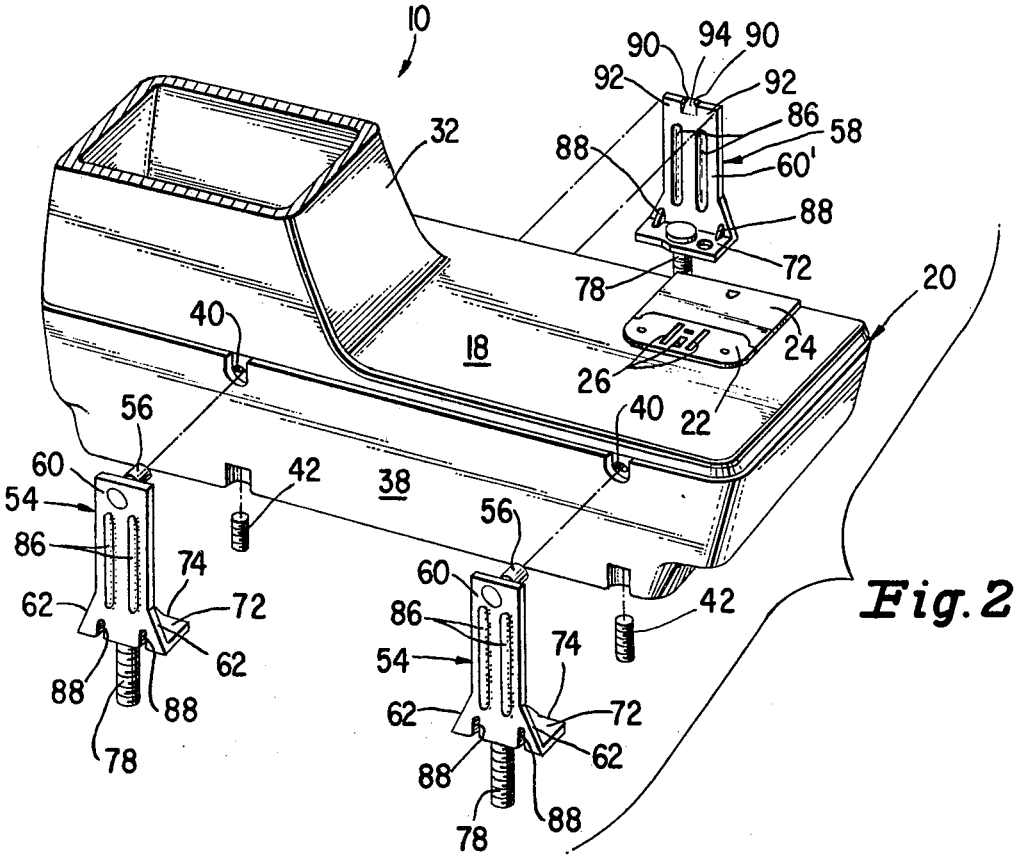
Fig. 2
Fig. 3
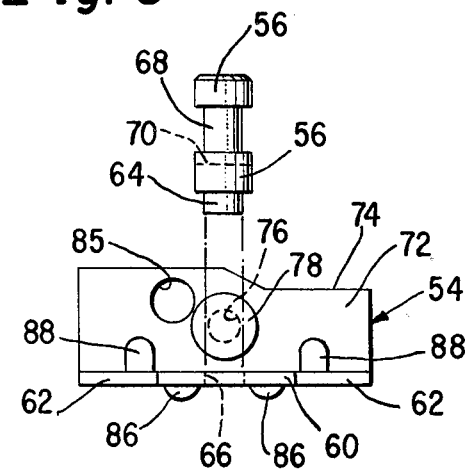
Fig. 4
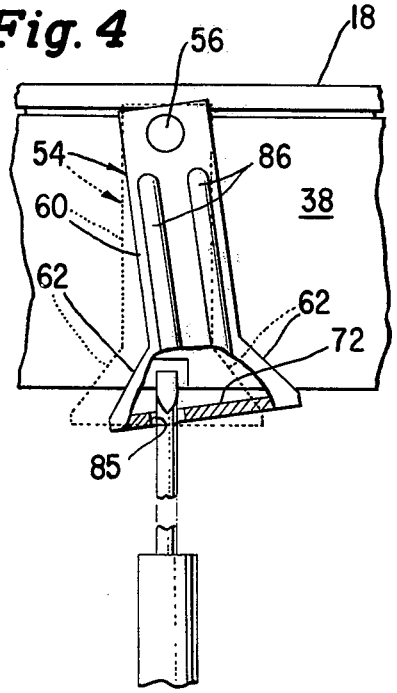

SEWING MACHINE MOUNT

FIELD OF THE INVENTION

This invention relates generally to the sewing machine arts and, more particularly to the mounting of sewing machines to sewing machine cabinets, tables, and the like.

BACKGROUND OF THE INVENTION

Many sewing machines of the flatbed variety are provided along one edge of the machine bed with a pair of sockets for mounting the machine as a drop-head in a cabinet, desk, or the like. For such drop-head mounting, the sewing machine is generally secured by hinges fastened along one edge of the well of the cabinet with the sewing machine secured to the hinges by means of pins connected to the hinges which extend into the corresponding sockets in the sewing machine bed. The pins are secured in the sockets by means of set screws which hold them fast. The distance from the socket centers to the work supporting surface are standardized so that this arrangement consistently locates the work supporting surface of the machine at the desired height, independent of the height or depth of the bed.

Many cabinets are now designed to accommodate convertible bed machines and such cabinets may include a hinged, movable, or fixed wooden shelf on which the machine rests and the sewing machine is adapted to be clamped by means of a hook fastener or the like. These cabinets cannot be presently utilized for mounting models of sewing machines that do not include hook sockets and they make the height of the work supporting surface dependent on the height or depth of the machine bed. The brackets and system of the present invention enable the mounting of sewing machines to such cabinet platforms by utilizing the hinge pin sockets for securing the brackets to the machine bed and for locating the work supporting surface at the desired height independent of the machine bed depth or height.

OBJECTS OF THE INVENTION

Bearing in mind the foregoing, it is a primary object of the present invention to provide novel and improved methods, apparatus, brackets and systems for sewing machine mountings.

Another primary object of the present invention, in addition to the foregoing object, is the provision of novel and improved mounting of brackets for sewing machines which can be connected with the sewing machine frame by cooperation with conventionally furnished hinge pin sockets and which can be fastened to a sewing machine cabinet or console sewing machine supporting surface or shelf.

Still another primary object of the present invention, in addition to the foregoing objects, is the provision of a novel and improved method, apparatus, and system, for mounting sewing machines to cabinets, tables, consoles, and the like while locating the machine height from the work supporting surface thereof and therefore the height of the work supporting surface of the machine independent of the height or depth of the machine bed.

Yet another primary object of the present invention, in addition to each of the foregoing objects, is the provision of novel methods, apparatus, brackets and systems for enabling a flat bed, drop-head sewing machine to be mounted to a cabinet initially designed to accommodate convertible bed machines.

Yet still another primary object of the present invention, in addition to each of the foregoing objects, is the provision of such novel and improved methods, apparatus, brackets and systems, which are economical to manufacture, easy to install, and which yet will securely position and retain a sewing machine and a cabinet.

A yet still further primary object of the present invention, in addition to each of the foregoing objects, is the provision of a novel conversion kit or mounting system for flat bed sewing machines which enables the use of a single, uniform kit of parts for converting any of a manufacturer's line of flat bed sewing machines for use with any of the manufacturer's line of sewing machine cabinets, tables, and the like, thereby enabling a single line of cabinets, tables, and the like to be universely used with the manufacturer's entire line of both flat bed and cylinder bed machines.

The invention resides in the combination, construction, arrangement and disposition of the various component parts and elements incorporated in new and improved apparatus, brackets and systems for sewing machine mounting and in the methods of mounting therewith all in accordance with the principles of this invention. The present invention will be better understood and objects and important features other than those specifically enumerated above will become apparant when consideration is given to the following details and description which, when taken in conjunction with the annexed drawing, describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

In accordance with the present invention, three supports are utilized to mount a drop-head, flat bed sewing machine to a shelf of a cabinet which may be initially designed to accommodate convertible or cylinder bed machines. Two of the supports comprise brackets provided with studs or pins which can be inserted into the hinge pin sockets conventionally provided in such machines and locked thereto by means of the set screws normally utilized to secure such machines to the hinges of drop-head machine cabinets. The brackets are also provided with threaded fasteners so that they can be affixed to the hinged wooden shelf of the sewing machine cabinet. The third support is a machine rest also mounted to the shelf of the sewing machine cabinet and the front of the sewing machine rests therein. Accordingly, a tripodal supporting system for the sewing machine is achieved that locates the machine height from the work supporting surface of the machine and, therefore, locates the work supporting surface of the machine at a height which is independent of the height or depth of the machine bed.

DESCRIPTION OF THE DRAWING

While the specification concludes with claims particularly pointing out and distinctly claiming the subject matter which is regarded as forming the present invention, it is believed the invention will be better understood from the following detailed description which, when taken in conjunction with the annexed drawing, describes, discloses, illustrates and shows a preferred embodiment or modification of the present invention and what is presently considered and believed to be the best mode of practicing the principles thereof and wherein:

FIG. 2 is an exploded perspective illustration, taken generally from above and to the rear of the sewing machine and the support system of the present invention;

FIG. 3 is an exploded plan view of one of the machine supporting brackets of the present invention illustrating the method of assembly thereof; and FIG. 4 is a partial elevational view of the machine and one of the supporting brackets illustrating the method of assembly thereof in accordance with the present invention.

DETAILED DESCRIPTION OF THE INVENTION

Figure 1:
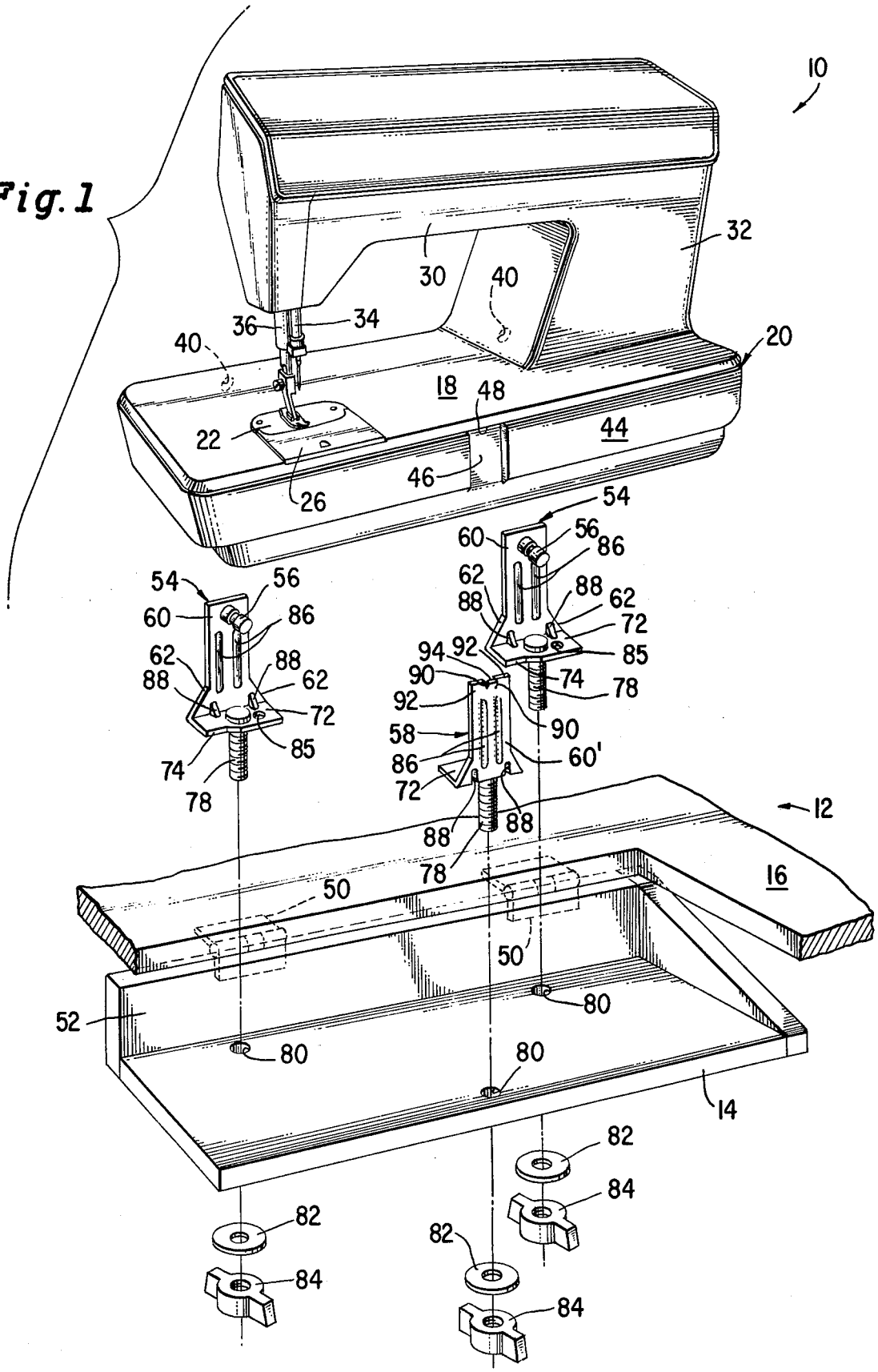
FIG. 1 is an exploded perspective illustration, generally from above and in front, of a typical and exemplary drop-head, flat bed sewing machine, a portion of a typical and exemplary cabinet including an auxiliary work support extension surface having a machine recess, and a hinged wooden shelf therebeneath to which the sewing machine is to be attached in accordance with the present invention, and a mounting and supporting system for mounting the machine to the shelf and locating the machine from the work supporting surface thereof so that such work supporting surface is automatically aligned by the supporting system planar with the cabinet auxiliary work support extension surface and independent of the height or depth of the machine bed.

With reference now to the drawing, wherein like reference characters are used for similar parts throughout the various views, there is shown and illustrated a typical, exemplary, drop-head, flat bed sewing machine designated generally by the reference character 10, a portion of a typical, exemplary sewing machine cabinet designated generally by the reference character 12 and comprising a machine supporting surface or shelf portion 14 upon which the sewing machine 10 may be mounted together with a novel and improved mount system comprising a pair of identical mounting brackets adapted to be fixedly mounted with both the sewing machine 10 and the shelf member 14 in a manner to be described together with a machine rest member adapted to be fixedly mounted with the shelf member 14 and upon which a forward edge portion of the sewing machine 10 rests.

Throughout the specification and claims, it is to be expressely understood that neither the specific sewing machine nor the specific cabinet described and shown nor even the use of the terms "cabinet," "console," "table," or the like terms are intended to in any way be limiting to the scope of the invention, since a part of the novelty and utility of the present invention is its universitality of application to many machines, cabinets, tables, consoles, and the like.

As will be appreciated by those having skill in in the sewing machine art, it has long been a common practice to provide integral with the bed or frame, particularly of flat bed sewing machines, a pair of sockets into which may be fitted hinge pins to enable the sewing machines to be mounted in a drop-head configuration with a cabinet, table, or the like. Such a system is taught as early as, for example, Diehl et al U.S. Pat. No. 541,474 dated June 25, 1895. Moreover, it will also be understood that by "drop-head" mounting it is meant that the sewing machine head or, entire machine if containing an integral motor, is pivotally mounted to a cabinet, table, or the like along a hinge line generally adjacent one edge of the bed or work supporting surface of the machine so as to be capable of being pivoted downwardly therearound to a concealed, storage position generally beneath the work support extension surface 16 forming a part of the cabinet 12 and which is desireably in planar orientation with the work supporting surface 18 of the bed 20 of the sewing machine 10 when the machine is lifted into its operative position.

Moreover, neither sewing machine 10 nor the cabinet or support 12 form a part of the present invention. Rather, the bracket supporting system of the present invention is expressly constructed and arranged so as to be suitable with conventionally any of a wide range of sewing machines and cabinets. In this connection, detailed description of the sewing machine is not believed necessary, since the sewing machine shown and illustrated is merely exemplary. To briefly describe the machine, however, in accordance with conventional practice it comprises the bed portion 20 having its upper surface defining the flat bed or work supporting surface 18, provided with needle and thread plates 22 and 24 respectively, a drop-feed mechanism comprising feed dogs 26 extending through the needle plate 22, and an arm 30 structually associated with the bed 20 as by a standard 32. The arm carries a needle bar and needle arrangement 34 and a presser bar and presser foot arrangement 36 which form a part of and cooperate with stitch forming mechanism contained within the bed 20 as is all well known in the art.

As heretofore pointed out, flat bed sewing machines have long been provided with a pair of hinge pin receiving sockets adjacent the upper rear edge of the machine bed adjacent but spaced apart from the work supporting surface. As will also be appreciated by those having familarity with the sewing machine arts, the dimensions and locations of these pin receiving sockets have long since been standardized, at least by individual manufacturers so that the manufacturer's various cabinets and machines may be interchanged and combined. In the United States, the accepted standard has been developed by The Singer Sewing Machine Company, which has been for many years uniformly used by The Singer Company for all flat bed machines and, in fact, many other manufacturers adapted the Singer standard so that their machines could be utilized with Singer cabinets. It will be recognized that critical parameters are, of course, diameter and center-to-center spacing. Additionally, and what might not be so generally recognized, is that the spacing of the holes from the work supporting surface 18 is of upmost criticality to the concept of interchangeability. This is so because, in the installation of a flat bed machine to a cabinet, planar continuity of the work surface 18 of the machine bed 20 with the auxiliary work supporting extension surface of the cabinet is very highly desirable.

Accordingly, with more particular attention now to FIG. 2, wherein the rear surface 38 of the sewing machine bed 20 may be clearly seen, as may the hinge pin receiving sockets 40, the conventional hinge pin socket arrangement positions two $\frac{1}{4}$ inch diameter socket holes 40 with their centers beneath the work supporting surface 18 by a distance of ⅜ inch and in drop-head mounting of the sewing machine 10, this distance determines the spacing of the hinge pins beneath the cabinet auxiliary work supporting extension surface. In general, the overall height of the bed and the depth of the bed 20 of a flat bed machine beneath the hinge pin sockets 40 is of no significance to the fitting of the machine within a cabinet. It is the alignment and height of the work supporting surface 18 above the hinge pin sockets 40 that is the critical parameter.

In addition to the hinge pin receiving sockets 40, the bed 20 is bored and threaded perpendicular and intersecting the hinge pin receiving socket 40 for set screws 42 which, as may be appreciated, are designed to be tightened against the hinge pins of a drop-bed cabinet for a flat bed machine to lock the hinges to the machine bed 20. If the design of the machine is such that the rear surface 38 is not generally smooth and planar as in the machine 10, bosses, or the like, may be provided to properly position the hinge pin sockets 40.

In conventional drop-head hinge mounting of a sewing machine, the rear edge of the work supporting surface 18, as hereinabove described, is positioned and aligned by the hinges and additional structure is provided for positioning the front edge of the machine. For example, various counter balance and locking hinge arrangements have been used. Most commonly, however, the front of the machine bed 20 may be easily supported by providing a hinged panel which may be manually swung upwardly to enable swinging movement of the sewing machine between its operative and stored positions and swung then downwardly back into a horizontal position whereat it engages a forward edge portion of the bed 20 below the work supporting surface 18 to hold the machine in a horizontal, working position. With particular attention to FIG. 1, the sewing machine 10 is provided, in the forward surface 44 of the sewing machine bed 20, with a generally vertically extending recess or groove 46 terminating at its upward extremity in a generally horizontally extending downwardly facing shoulder 48 spaced apart, again, conventionally a distance of ¼ inch below the work supporting surface 18 of the machine bed 20 for engagement by such a member as may be conventionally carried by a drop-head cabinet to support the forward edge of the machine.

With the introduction of cyclinder bed machines, the standard sewing machine mounting features, such as the hinge pin sockets 40 and front edge supporting shoulder 48 could no longer be provided since the cylinder free-arm or bed would not be sufficient extensive to reach the edge of the machine recess. Accordingly, cabinets such as the cabinet 12 were designed wherein the machine is supported, rather than by hinge pins, by its base, on a shelf such as the shelf 14. The shelf 14 of the cabinet 12 provides a drop-head action by means of being hinged to the work supporting surface or top panel 16 by means of hinges 50 and a rear panel 52 fixed generally perpendicular the machine supporting shelf 14. Additional means, not shown, are provided for selectively positioning the shelf 14 in its generally horizontal sewing position, as shown in FIG. 1, or pivoted downwardly into a machine storing position, not shown. With cylinder bed machines, the machine is generally clamped to the supporting shelf 14 by a hook mechanism and the location of the work supporting surface of the machine relative the shelf 14 is determined by the height of the work supporting surface above the machine base or, alternatively, by the depth of the bed or base beneath the work supporting surface.

It is to be expressely understood, however, that the uniqueness and utility of the present machine mounting supporting system is not limited to use with a drop-head shelf, such as the shelf 14 of the cabinet 16. Rather, much of the utility and uniqueness of the present supporting system is its universitality of application, enabling flat bed machines provided with hinge pin sockets to be quickly and easily mounted, using the identical mounting parts, to substantially any cabinet, table, shelf, or the like, whether of hinged, drop-head type, elevator platform mechanism, or to a fixed machine supporting surface, or the like. In effect, therefore, the present machine mounting system enables a manufacturer to provide its entire line of cabinets, tables, and the like, to be readily utilized with either cylinder bed or flat bed machines and enables machines initially designed for mounting by means of hinge pins, to be mounted quickly and easily to a cabinet lacking such hinge pins but having a machine support surface spaced below the auxiliary work supporting surface of the cabinet, or the like.

In accordance with the present system for sewing machine mounting, a sewing machine mount system is provided which comprises a pair of identical uniform height brackets designated generally by the reference character 54 which in turn comprise pin members 56 adapted to be inserted and engaged into the hinge pin sockets 40 of the machine bed 20 and locked thereto, by the set screws 42. The brackets 54 are also adapted to be mounted with a support surface, such as the shelf 14 of a cabinet 12, so as to support the rear of the surface 18 of the sewing machine 10 in fixedly spaced apart relationship to the shelf 14. Hence, the work supporting surface 18 of the sewing machine is accurately and automatically positioned thereby into planar cooperation with the auxiliary work supporting extension surface 16 of the cabinet 12 since in this type of cabinet the depth of the recess, from the auxiliary work supporting extension surface 16 to the shelf or machine supporting surface 14, is standardized and uniform for all cabinets of a single line. Further, the mounting bracket system comprises a machine rest, designated generally by the reference character 58 adapted to be carried by the shelf or machine supporting surface 14 generally in alignment with the front edge of the sewing machine bed 20 to engage the shoulder 48 of the recess or groove 46 to thereby position and support the forward edge portion of the work supporting surface 18 also automatically at the desired height. As pointed out above, since the groove or recess 46 and the supporting shoulder or flange 48, as well as the hinge pin sockets 40 are accurately and consistently positioned in a fixed spaced apart relationship with the work supporting surface 18 of the bed 20, the brackets 54 will automatically and uniformly position the sewing machine 10 in its proper orientation regardless of the depth of the bed 20 beneath the pin sockets 40. The arrangement of the two brackets 54 and the machine rest 58 is that they are each spaced apart from one another to form a tripodal supporting system for the machine 10 giving very stable support thereto.

Each of the mounting brackets 54 are identical and, therefore, will be described in the singular. Hence, the bracket 54 comprises an elongated leg portion 60 of generally rectangular configuration flared outwardly at its lower end portion to form two reenforcing generally triangular gusset portions 62. As has been heretofore pointed out, the bracket 54 is provided with a pin 56 adapted to be inserted into one of the machine bed hinge pin sockets 40 and locked therein, as by the set screws 42, to fixedly mount the bracket 54 to the machine bed 20. Accordingly, the pin 56 is preferably associated with the upstanding leg 60 generally adjacent one end thereof. The pin 56 may, for example, comprise a reduced diameter distal end portion 64 which may be inserted into and through an aperture 66 extending through the upstanding leg 60 of the bracket 54 and peened over so as to rivet the pin 56 to the upstanding leg 60 of the bracket 54. Further, the pin may be provided with an annular relief groove 68 intermediate its ends as well as a chordal flat 70.

The other end portion of the bracket 54 may be bent to extend generally perpendicular the upstanding leg 60 to provide a base portion 72 of integral, one piece construction with the upstanding leg 60. The base portion 72 is of generally rectangular configuration, with one edge being notched, as at 74 to aid in installation to the machine 20, as will be detailed hereinafter. Further, the base portion 72 may be provided with a plurality of apertures, a generally central aperture 76 in general radial alignment with the pin 56 into which may be press fit a knurled shank bolt 78 for mounting the bracket 54 with the shelf 14. The bolt 78 may then be threaded through an appropriate aperture 80 provided through the shelf 14 and, together with a washer 82 to bear against the lower surface of the shelf 14 and, for example, a wing nut 84, thereby clamp the shelf 14 between the bracket base portion 72 and the washer 82 and thereby define fastener means for structurally associating each of the mounting brackets 54 securely and rigidly with the shelf or machine supporting surface 14. Preferably, the wing nut 84 is of a self-locking variety, such as by being provided with a plastic insert so as to be resistant to inadvertent and undesirable loosening due to machine vibration, and the like.

In addition, each bracket base portion 72 is provided with an offset screw driver blade clearance aperture 85 adjacent the bolt aperture 76 and on the side thereof opposite the notch 74. The clearance aperture 85 is spaced apart from the upstanding leg 60 a distance such that, when the pin 56 is inserted into the hinge pin socket 40, the bracket 56 may be pivoted slightly around the axis of the pin 56 to align the clearance aperture 85 with the set screw 42, as shown in solid lines in FIG. 4, enabling the set screw 42 to be tightened against the associated pin 56 by insertion of a screw driver through the clearance aperture 85. Thereafter, following removal of the screw driver from the aperture 85, the bracket 56 can be slightly rotated around the axis of the pin 60 to align the upstanding leg 60 vertically, with the bolt 78 directly beneath the pin 60, as shown in dotted lines in FIG. 4. Two mechanisms are available to permit this slight rotation or rocking movement after the set screw 42 has been tightened against the pin 56. Firstly, as pointed out above, the pin 56 is preferably peened or riveted to the upstanding leg 60 of the bracket 54 and sufficient motion may be available within this joint to enable the small degree of rotation necessary. Secondly, some slight rotational slippage of the pin 56 against the restraint of the set screw 42 may occur. On some model sewing machines having a very large bed 20, such as the 900 series sewing machines manufactured by The Singer Company, insufficient clearance beneath the machine would exist for rotating the bracket 54 as aforesaid, unless the notch 74 is provided. This notch gives sufficient clearance to enable the installation rotation as aforesaid.

The bracket 56, which may be fabricated of cold rolled steel strip, may be further strengthened and rigidified against inadvertant and undesired bending by the provision of a pair of longitudinally extending ribs 86 swaged into the upstanding leg 60 and a pair of right angle gusset ribs 88 swaged across the bend line between the upstanding leg 60 and the base 72.

The lower end portion of the machine rest 58 may, for convenience in tooling and manufacture, be fabricated identical to the lower end portions of the brackets 54. Accordingly, the machine rest 58 may comprise an upstanding leg portion 60' provided with swaged longitudinally extending ribs 86, a base portion 72, a pair of swaged right angle triangular gusset ribs 88 and a knurled shank bolt 78. Similar to the brackets 54, the machine rest 58 may be affixed to the shelf 14 by means of a washer 82 and wing nut 84.

Rather than being provided with an aperture 66 and pin 56, the upper end portion of the machine rest 58 is trifurcated by means of a pair of sheared slits 90 to provide two outermost fingers 92 and a generally medial central finger 94. At least one of the fingers, such as, for example, the finger 94, may be bent generally outwardly of the plane of the leg portion 60', so as to provide an increased apparent thickness to the upper end portion of the machine rest 58 and the trifurcated end portion be ground flat and to length so as to automatically and rigidly support the machine 10 with the work surface thereof horizontal and aligned with the working surface 16 of the associated cabinet 12.

After the brackets 54 have been secured to the machine bed 20, as aforesaid, the bolts 78 may be inserted downwardly through the apertures 80 in the shelf 14 and the washers 82 and wing nuts 84 installed.

In addition, to enable the holes 80 to be predrilled in the shelf 14 while enabling installation adjustments for normal tolerance variations, the holes 80 may be drilled slightly oversized, and the flat washers 82 replaced with star washers, whose teeth will imbed or lock into the undersurface of the shelf 14, rigidly positioning the mount system relative the slightly oversize holes, upon tightening of the wing nuts 84.

While the invention has been described, disclosed, illustrated and shown in terms of an embodiment or modification which has assumed in practice, the scope of the invention should not be deemed to be limited by the precise embodiment or modification herein described, disclosed, illustrated or shown, such other embodiments or modifications as may be suggested to those having the benefit of the teachings herein being intended to reserved especially as they fall within the scope and spirit of the claims here appended.

I claim:

1. A sewing machine mount system for mounting to a machine supporting surface or shelf of a sewing machine cabinet, table, or the like, a sewing machine having a pair of hinge pin sockets provided in a side of the machine bed adjacent and specifically spaced from an edge of the work support surface thereof comprising, in combination, a pair of uniform height generally rigid mounting brackets structurally adapted, constructed and arranged to be affixed to the machine bed through cooperation with the hinge pin sockets to depend downwardly thereof to rest on and be also affixed to such machine supporting surface or shelf, together with a flat topped machine rest member structurally adapted, constructed and arranged to be fixedly carried by said machine supporting surface or shelf for extending upwardly thereof to engage a shoulder or flange of such machine bed on a side thereof adjacent an edge of the machine bed work support surface opposite the edge adjacent the pin sockets and sized so as to maintain such work supporting surface of said machine bed parallel such machine supporting surface or shelf with the machine being located automatically thereby with the machine work supporting surface a fixed and specified distance from the machine supporting surface or shelf independent of the depth of the machine bed beneath the pin sockets.

2. Sewing machine mount system defined in claim 1 for use in a cabinet having a work supporting extension surface parallel and spaced apart from said machine supporting surface or shelf wherein said brackets and said machine rest are each of a height such that the machine is supported with the work supporting surface thereof planar the work supporting extension surface of such cabinet.

3. Sewing machine mount system defined in claim 1 wherein each of said mounting brackets comprise an upstanding elongated leg carrying, adjacent one end portion thereof, a pin adapted to be inserted each into one of the machine bed hinge pin sockets and locked therein, as by set screws, to fixedly mount each said bracket to said machine bed in specifically determined relationship to the work supporting surface of the machine bed.

4. Sewing machine mount system defined in claim 3 further comprising a fastener means structurally associated with each said mounting bracket adjacent the end portion thereof opposite said pin for fixedly mounting said bracket to such machine supporting surface or shelf.

5. Sewing machine system defined in claim 4 wherein said fastener means comprises a bolt and nut combination.

6. Sewing machine mount system defined in claim 5 wherein said bolt is fixedly mounted with said bracket forming a unitary assembly therewith so that after assembly of said brackets with a machine, they can be handled and assembled with the machine supporting surface or shelf as a unitary assembly.

7. Sewing machine mount system defined in claim 3 wherein each of said mounting brackets further comprise a base leg extending perpendicular said upstanding leg adjacent the end portion thereof opposite said pin for resting on the machine supporting surface or shelf, together with fastener means for fixedly mounting said base leg with such supporting surface or shelf.

8. Sewing machine mount system defined in claim 7 wherein each of said base legs is provided with a pair of spaced apart apertures, one being in alignment with said pin to provide for installation of the fastener means for mounting said bracket to said supporting surface or shelf, the other aperture being skewed or offset therefrom for providing clearance for a screw driver shaft during installation of the bracket to the machine bed, said pin enabling rocking of said bracket between a first position enabling alignment of said offset aperture with a set screw in the machine base for engaging said bracket pin and the passage of a screw driver shaft through said offset aperture to engage the set screw for tightening thereof, and a second position perpendicular the machine bed.

9. Sewing machine mount system defined in claim 7 wherein said machine rest comprises a flat topped upstanding leg portion and a base leg extending perpendicular said upstanding leg for resting on the machine supporting surface and a bolt extending through said base leg for cooperation with a nut to mount said rest with such machine support surface or shelf.

10. Sewing machine mount system defined in claim 9 wherein said flat topped end portion of said machine rest is trifurcated to provide three generally parallel fingers, at least one of said fingers being bent outwardly of the plane of said upstanding leg to provide an increased apparent thickness thereto.

11. Sewing machine mount system defined in claim 7 wherein each upstanding leg and the associated said base leg are of integral, one-piece construction, being formed by bending of a single length of steel strip, each upstanding leg being reinforced against inadvertent bending by at least one longitudinally extending swaged rib.

12. Sewing machine mount system defined in claim 11 wherein said bracket further comprises a pair of swaged right angled triangular gussets extending across the bend between said base leg and said upstanding leg.

13. Sewing machine mount system defined in claim 12 wherein said machine rest comprises a flat topped upstanding leg portion and a base leg extending perpendicular said upstanding leg for resting on the machine supporting surface and a bolt extending through said base leg for cooperation with a nut to mount said rest with such machine support surface or shelf.

14. Sewing machine support system defined in claim 13 wherein said flat topped end portion of said machine rest is trifurcated to provide three generally parallel fingers, at least one of said fingers being bent outwardly of the plane of said upstanding leg to provide an increased apparent thickness thereto.

15. A sewing machine mount bracket for mounting to a machine supporting surface or shelf of a sewing machine cabinet, table, or the like, a sewing machine having a pair of hinge pin sockets provided in a side of the machine bed adjacent and specifically spaced from an edge of the work support surface thereof comprising, an upstanding elongated leg carrying, adjacent one end portion thereof, a pin adapted to be inserted into one of the machine bed hinge pin sockets and locked therein, as by a set screw, to fixedly mount said bracket to said machine bed in specifically determined relationship to the work supporting surface of the machine bed, and a base leg extending perpendicular said upstanding leg adjacent the end portion thereof opposite said pin for resting on the machine supporting surface or shelf, together with fastener means for fixedly mounting said base leg with such supporting surface or shelf.

16. Sewing machine mount bracket defined in claim 15 wherein said base leg is provided with a pair of spaced apart apertures, one being in alignment with said pin to provide for installation of the fastener means for mounting said bracket to said supporting surface or shelf, the other aperture being skewed or offset therefrom for providing clearance for a screw driver shaft during installation of the bracket to the machine bed, said pin enabling rocking of said bracket between a first position enabling alignment of said offset aperture with a set screw in the machine base for engaging said bracket pin and the passage of a screw driver shaft through said offset aperture to engage the set screw for tightening thereof, and a second position perpendicular the machine bed.

17. Sewing machine mounting bracket comprising a pair of generally mutually perpendicular legs bent from a single piece of steel strip, one of said legs being of elongated generally rectangular shape and flared laterally outwardly to define generally triangular reinforcing gussets adjacent the juncture of said one of said legs with the other leg, said one of said legs being provided adjacent the end thereof opposite said other of said legs with a generally circular aperture, a shouldered generally cylindrical pin fitted into said aperture and peened so as to be riveted thereby to said one of said legs to extend generally perpendicular thereto, said pin being provided with a medial annular groove and said one of said legs being provided with a pair of spaced apart generally longitudinally extended swaged ribs to reinforce said one of said legs and aid in resisting unintentional bending thereof, a pair of generally triangular swaged right angle ribs extending across said bend between said legs to aid in resisting unintentional further bending or unbending thereof, said other leg being provided with a pair of spaced apart generally circular apertures, one of said apertures being located generally centrally thereof and radially alinged with said pin, a knurled shank bolt press fit into said one of said apertures with its threaded end extending generally away from said pin for enabling mounting to a machine supporting surface or shelf, and the other of said apertures being adjacent said one aperture and offset therefrom, enabling said bracket to be rocked or rotated about said pin for insertion of a screw driver shaft through said other aperture for tightening a set screw against said pin during installation of said bracket.

18. Bracket defined in claim 17 wherein said other of said legs is notched on a side thereof across said one aperture from said other aperture to provide additional clearance for rocking said bracket around said pin during installation to a machine bed.

19. A sewing machine mount system for mounting to a machine supporting surface or shelf of a sewing machine cabinet, table, or the like, a sewing machine having a pair of hinge pin sockets provided in a side of the machine bed adjacent and specifically spaced from an edge of the work support surface thereof comprising, in combination, a pair of uniform height generally rigid and mounting brackets structurally adapted, constructed and arranged to be affixed to the machine bed through cooperation with the hinge pin sockets to depend downwardly thereof to rest on and be also affixed to such machine supporting surface or shelf together with a flat topped machine rest member structurally adapted, constructed and arranged to be fixedly carried by said machine supporting surface or shelf for extending upwardly thereof to engage a shoulder or flange of such machine bed on a side thereof adjacent an edge of the machine bed work support surface opposite the edge adjacent the pin sockets and sized so as to maintain the work supporting surface of said machine bed parallel the machine supporting surface or shelf and spaced apart from each of said mounting brackets so as to provide therewith a tripodal supporting system for the machine bed.

20. Method of installing, to a sewing machine having in a bed thereof adjacent an edge of the work supporting surface a hinge pin socket and a threaded set screw carrying passageway intersecting and extending downwardly of said hinge pin socket, a supporting bracket having a pin adapted to be engaged with the hinge pin socket and secured therein by the set screw and a base portion generally parallel and spaced apart from such pin which carries a mounting bolt in general alignment with such pin, comprising, at least the steps of, providing a screw driver clearance aperture in such base portion adjacent such mounting bolt, rotating such bracket around the pin axis to position the screw driver clearance aperture in alignment with the set screw, inserting a screw driver shank through such clearance aperture skewed relative the axis of the bracket to engage the set screw, tightening the set screw against the bracket pin, removing the screw driver from the clearance aperture and subsequently rotating the bracket around the pin axis a sufficient distance to align the mounting bolt parallel the set screw axis and perpendicular the sewing machine bed.

21. Method of mounting to a machine supporting surface or shelf of a sewing machine cabinet, table, or the like, a sewing machine having a pair of hinge pin sockets provided in a side of the machine bed adjacent and spaced from an edge of the work support surface thereof comprising, at least the steps of, affixing to the machine a pair of uniform height mounting brackets structurally adapted, constructed and arranged to be affixed to the machine bed through cooperation with the hinge pin sockets to depend downwardly therefrom, affixing the opposite end portions of such brackets to such machine supporting surface or shelf, affixing to the machine support surface of shelf in spaced apart relationship to said brackets a flat top rest member structurally adapted, constructed and arranged to be fixedly carried by said machine supporting surface or shelf extending upwardly thereof, and engaging a shoulder or flange of such machine bed on a side thereof adjacent an edge of the machine bed work support surface opposite the edge adjacent the pin sockets against the top of such machine rest to position the work supporting surface of such machine bed parallel the machine supporting surface or shelf, and thereby supporting the machine above such supporting surface of shelf on a tripodal supporting system with the work supporting surface of the machine specifically spaced apart from the machine supporting surface of shelf.

* * * * *